US008701358B1

(12) United States Patent
Bethlendy, Jr.

(10) Patent No.: US 8,701,358 B1
(45) Date of Patent: Apr. 22, 2014

(54) MASONRY BLOCK PLATE SETTER

(76) Inventor: George Bethlendy, Jr., Pittsford, NY (US)

( * ) Notice: Subject to any disclaimer, the term of this patent is extended or adjusted under 35 U.S.C. 154(b) by 154 days.

(21) Appl. No.: 13/468,531

(22) Filed: May 10, 2012

Related U.S. Application Data

(60) Provisional application No. 61/594,703, filed on Feb. 3, 2012.

(51) Int. Cl.
*E04B 1/00* (2006.01)

(52) U.S. Cl.
USPC ..... 52/127.3; 52/127.4; 52/585.1; 52/592.5

(58) Field of Classification Search
USPC ..... 52/127.1, 127.3, 127.4, 561–565, 52/514.5, 582.1, 585.1, 597, 604, 606, 52/607, 699
See application file for complete search history.

(56) References Cited

U.S. PATENT DOCUMENTS

| | | | | |
|---|---|---|---|---|
| 2,543,716 | A * | 2/1951 | Carini | 33/518 |
| 4,729,540 | A * | 3/1988 | Rozema | 249/1 |
| 6,401,406 | B1 * | 6/2002 | Komara | 52/127.3 |
| 6,463,710 | B1 * | 10/2002 | Barnhart | 52/698 |
| 8,109,054 | B2 * | 2/2012 | Thomas et al. | 52/220.2 |

* cited by examiner

*Primary Examiner* — Brian Glessner
*Assistant Examiner* — Adam Barlow
(74) *Attorney, Agent, or Firm* — Robert J. Bird

(57) ABSTRACT

A system for setting and securing metal plate on an outer wall of concrete masonry, includes upper and lower masonry blocks with side walls and end walls forming an inner grout cavity. The metal plate has Nelson studs extending from it, each having a head on its outer end The studs extend from the plate, through a masonry side wall, into the grout cavity. A spring clip in the grout cavity compressed between a masonry block side wall and the stud head urges the stud and plate inward to secure the plate against the masonry as the grout cavity is filled with grout.

9 Claims, 3 Drawing Sheets

MASONRY BLOCK PLATE SETTER

CROSS-REFERENCE TO RELATED APPLICATION

My related and Provisional Application No. 61/594,703 was filed on Feb. 3, 2012. That filing date is claimed for this application.

BACKGROUND INFORMATION

This invention relates to masonry block work, and more specifically to a system for gripping and securing steel plate against an outer wall of concrete masonry block(s) during the block grouting process.

In the prior art, such steel plates are temporarily propped up by various makeshift means or techniques which are labor and time consuming, and less than satisfactory.

SUMMARY OF THE INVENTION

In summary, this invention is a system for setting and securing metal plate on an outer wall of concrete masonry. It includes masonry blocks with side walls and end walls forming an inner grout cavity. The metal plate has Nelson studs extending from it, each having a head on its outer end. The studs extend from the plate, through a masonry side wall, into the grout cavity. A spring clip in the grout cavity compressed between a masonry block side wall and the stud head urges the stud and plate inward to secure the plate against the masonry as the grout cavity is filled with grout.

DRAWINGS

DESCRIPTION

Figure 1:
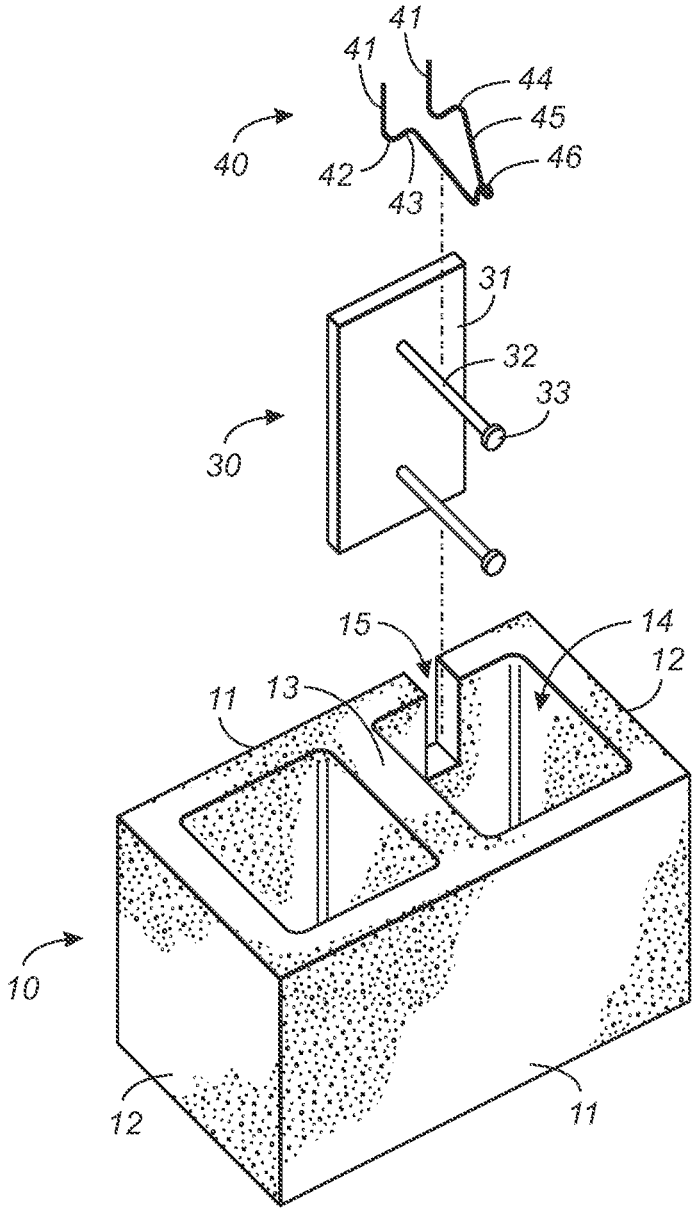
FIG. 1 is an exploded view of a concrete masonry block and a plate setter system of this invention.

With reference now to the drawings:

FIG. 1 is an exploded view of a concrete masonry block 10, a steel plate member 30 to be secured against an outside wall of the block 10, and a spring clip 40.

The block 10 includes sidewalls 11, end walls 12, and an inner partition 13, all together forming inner cavities or spaces 14. The block 10, otherwise conventional, in this invention further includes a partial vertical slot 15 upward through one of its sidewalls 11.

The plate member 30 includes a steel plate 31 with fixed studs 32, known in the trade as Nelson studs, extending perpendicularly from it. Each stud 32 includes a head 33 on its outer end. Studs 32 may be threaded into the plate 31, or welded to it, or fixed to it by a bayonet fitting, or other appropriate means as desired.

The spring clip 40 is formed of spring wire. It includes left and right feet 41, ankles 42, lower legs 43, knees 44, and upper legs 45. The outer ends of legs 45 are connected to opposite ends of an arched yoke 46.

Figure 2:
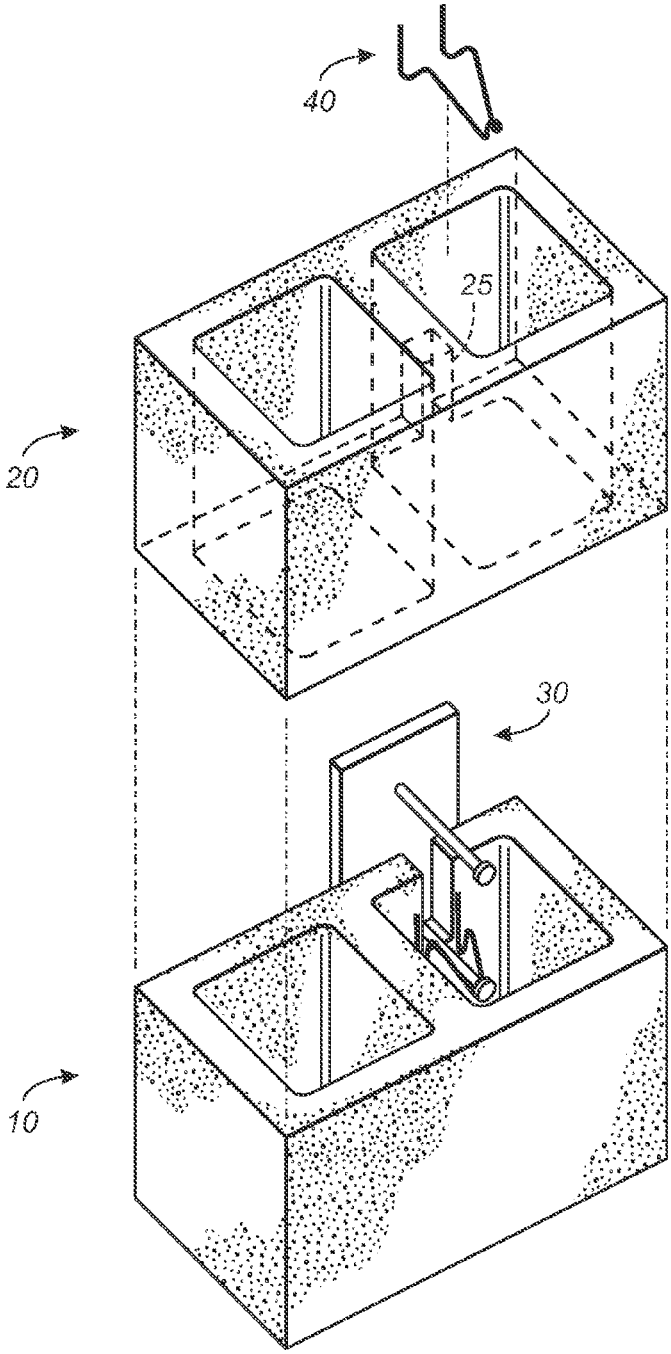
FIG. 2 is similar to FIG. 1, with an additional masonry block for placement on the lower block.

FIG. 2 includes the elements of FIG. 1 and, in addition, a second block 20 having a partial vertical slot 25 downward through a sidewall. In this view, the plate member 30 is moved into place relative to the lower block 10, with one of its studs 32 now extending through the slot 15 of the lower block 10.

Figure 3:
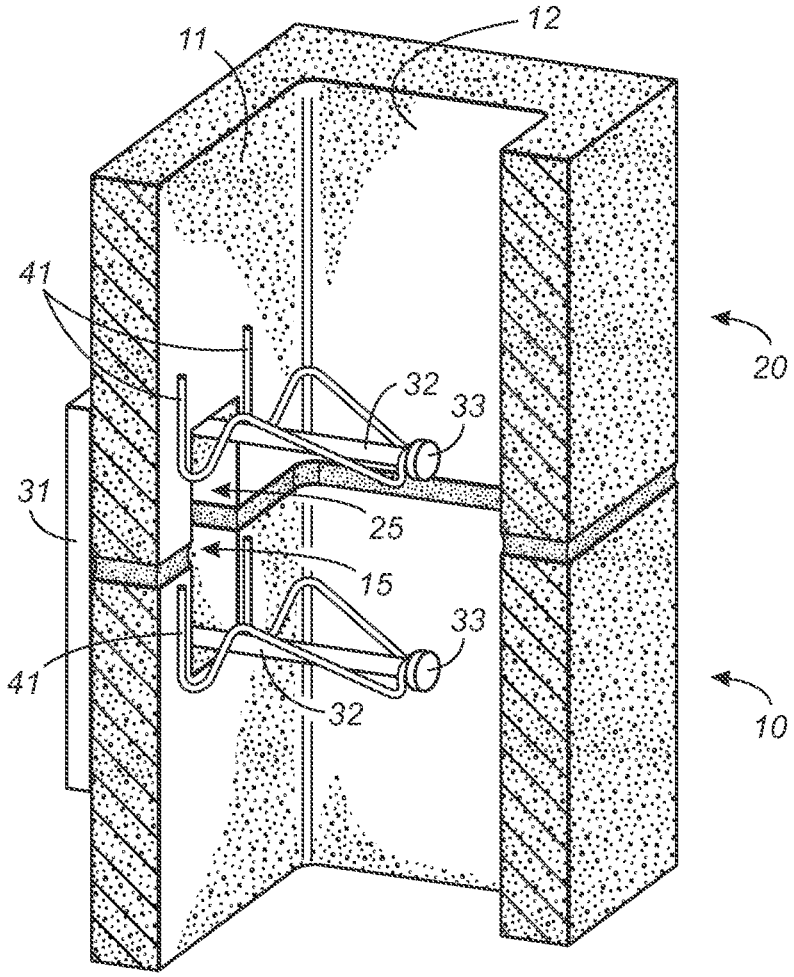
FIG. 3 is a cutaway interior view of upper and lower masonry blocks with the system of this invention in place.

FIG. 3 is a cutaway view of the interior of blocks 10 and 20. The upper block 20 is now mounted on the lower block 10. Their respective slots 25, 15 are aligned. The studs 32 now extend through the slots 25, 15 into the cavities 14 of upper and lower blocks 20, 10.

Also in FIG. 3, spring clips 40 are pressed into place, each straddling a stud 32. The spring clips 40 are now in compression, their feet 41 pressing against the block inner walls 11, and their yokes 46 pressing against the stud heads 33. The spring clips 40, pushing against the stud heads 33, thereby hold the steel plate 31 in place against the block outer wall 11. In the next step, the grout cavity 14 is filled with grout to thereby permanently embed and fix the studs 32 within the cavity, thereby to permanently fix the plate 31 to the blocks 10, 20.

In the following claims, any terms indicative of orientation (e.g. front, back; upper, lower; top, bottom; horizontal, vertical) are meant simply to correspond with the illustrations as an aid to understanding of the claimed invention. Such terms are not intended as positive limitations.

The foregoing description of a preferred embodiment is illustrative. The concept and scope of the invention are not limited by such details but only by the following claims.

What is claimed is:

1. A system for setting and securing a plate to an outer wall of concrete masonry, including:

a masonry block including side walls and end walls around an inner grout cavity;

a plate with studs extending from it, each of said studs having a plate end integral with said plate, and an outer end with a head thereon;

each of said studs extending from said plate through a sidewall of said block into said grout cavity; and a spring in said grout cavity operatvely connected to said head of said stud to urge said stud and said plate inward to secure said plate against an outer surface of said masonry block as said grout cavity is filled with grout.

2. A system as defined in claim 1, wherein said spring is a compression spring in compression between a side wall of said masonry block and said head of said stud.

3. A system as defined in claim 2, wherein said spring is a wire spring configured for placement by straddling said stud between the head thereof and said sidewall of said block.

4. A system for setting and securing a plate to an outer wall of concrete masonry, including:

upper and lower masonry blocks each including side walls and end walls around an inner space;

said upper masonry block mounted on said lower masonry block, the respective spaces in said blocks aligned with each other to form a grout cavity;

a plate with studs extending from it, each of said studs having a plate end integral with said plate, and an outer end with a head thereon;

said studs extending from said plate, through said sidewalls of said blocks, and into said grout cavity; and a spring in said grout cavity in compression between a side wall of said masonry block and said head of each of said studs to urge said studs and said plate inward to secure said plate against an outer surface of said masonry block as said grout cavity is filled with grout.

5. A system as defined in claim 4, wherein said springs are compression springs in compression between a side wall of said masonry block and said heads of said studs.

6. A system as defined in claim 5, wherein said springs are wire springs configured for placement by straddling said studs between the heads thereof and said sidewall of said block.

7. A system for setting and securing metal a plate to an outer wall of concrete masonry, including:

upper and lower masonry blocks each including side walls and end walls around an inner space, each of said masonry blocks further including a vertical slot through one of its side walls;

said upper masonry block mounted on said lower masonry block, the respective spaces in said blocks aligned with each other to form a grout cavity, and the respective slots in said blocks aligned with each other to form a stud slot;

a metal plate with studs extending from it, each of said studs having a plate end integral with said plate, and an outer end with a head thereon;

said studs extending perpendicularly from said plate, through said stud slot and into said grout cavity; and a spring in said grout cavity in compression between a side wall of said masonry block and said head of each of said studs to urge said studs and said plate inward to secure said plate against an outer surface of said masonry block as said grout cavity is filled with grout.

8. A system as defined in claim 7, wherein said springs are compression springs in compression between a side wall of said masonry block and said heads of said studs.

9. A system as defined in claim 8, wherein said springs is a wire springs configured for placement by straddling said studs between the heads thereof and said sidewall of said block.

* * * * *